US006815650B1

(12) United States Patent
Bartz

(10) Patent No.: US 6,815,650 B1
(45) Date of Patent: Nov. 9, 2004

(54) ENERGIZATION CYCLE COUNTER FOR INDUCTION HEATING TOOL

(76) Inventor: Kathleen M. Bartz, 41228 Julie, Clinton Township, MI (US) 48038

( * ) Notice: Subject to any disclaimer, the term of this patent is extended or adjusted under 35 U.S.C. 154(b) by 0 days.

(21) Appl. No.: 10/750,640

(22) Filed: Jan. 2, 2004

(51) Int. Cl.[7] ..... H05B 6/06; G07C 3/00

(52) U.S. Cl. ..... 219/663; 219/668; 377/15; 377/16

(58) Field of Search ..... 219/660–668; 377/15, 16

(56) References Cited

U.S. PATENT DOCUMENTS

| | | | | |
|---|---|---|---|---|
| 1,922,029 | A | | 8/1933 | Chesnut |
| 3,388,318 | A | | 6/1968 | O'Brien |
| 3,521,264 | A | | 7/1970 | Limon |
| 3,666,922 | A | | 5/1972 | Leitner et al. |
| 3,746,825 | A | | 7/1973 | Pfaffmann |
| 3,793,509 | A | * | 2/1974 | Isnard ..... 377/16 |
| 4,100,491 | A | | 7/1978 | Newman, Jr. et al. |
| 4,266,114 | A | * | 5/1981 | Hansen ..... 219/132 |
| 4,317,975 | A | | 3/1982 | Mizukawa et al. |
| 4,355,222 | A | * | 10/1982 | Geithman et al. ..... 219/633 |
| 4,768,209 | A | * | 8/1988 | Yu ..... 377/6 |
| 4,816,633 | A | | 3/1989 | Mucha et al. |
| 4,890,306 | A | | 12/1989 | Noda |
| 4,897,518 | A | | 1/1990 | Mucha et al. |
| 5,017,875 | A | | 5/1991 | Hori et al. |
| 5,250,776 | A | | 10/1993 | Pfaffmann |
| 5,434,389 | A | | 7/1995 | Griebel |
| 5,604,441 | A | | 2/1997 | Freese, V et al. |
| 5,808,557 | A | | 9/1998 | Berge et al. |
| 5,864,241 | A | | 1/1999 | Schreck et al. |
| 5,991,355 | A | | 11/1999 | Dahlke |
| 6,037,576 | A | | 3/2000 | Okabayashi et al. |
| 6,229,127 | B1 | | 5/2001 | Link |
| 6,295,330 | B1 | | 9/2001 | Skog et al. |
| 6,455,825 | B1 | | 9/2002 | Bentley et al. |
| 6,486,664 | B1 | | 11/2002 | Metodiev et al. |

* cited by examiner

*Primary Examiner*—Philip H. Leung
(74) *Attorney, Agent, or Firm*—Dobrusin & Thennisch, PC

(57) ABSTRACT

An induction heat treating process with a sensor for counting the amount of cycles attributable to an inductor coil. The sensor is preferably a counting mechanism attached to or embedded within the induction coil and is preferably triggered by and responds to the change in voltage generated as the coil is energized. Alternative means of measuring a cycle may be implemented. The output data from the sensor provides useful information for determining the lifespan of an induction coil. Predicting the lifespan of a coil optimizes production by anticipating failure and replacement of a coil during a predetermined down time, limiting on-site inventory, and revolutionizing the billing cycle based on a per cycle cost while decreasing overall production costs and improving inductor coil quality.

24 Claims, 4 Drawing Sheets

ENERGIZATION CYCLE COUNTER FOR INDUCTION HEATING TOOL

TECHNICAL FIELD

The present invention relates generally to a counting sensor for use in conjunction with an induction heat treating process. More particularly, the present invention relates to a system for counting the cycles of an individual inductor coil and maintaining and transmitting this data to a remote unit location or self contained unit within the counting sensor.

BACKGROUND OF THE INVENTION

The induction heat treating process is used in various applications for hardening, and annealing of metals. The process includes applying energy directly to metals and other conductive materials via an alternating electric current passing through an induction heating coil positioned in close proximity to a workpiece. A common use for induction heating is case hardening of carbon steel, or alloy parts for use in the formation of automobiles, farm equipment, airplanes and other production apparatuses. Induction heating rapidly heats the workpiece in a short period of time. The workpiece is then quenched and a hardened surface, or through hardened part is formed. The depth of the hardened surface is regulated by the frequency of current, temperature of the part surface, and quenching of the part.

Much of the prior art is directed to systems for measuring and maintaining the temper and surface hardness to insure proper performance and quality control of the heated parts. The concept of monitoring an induction heating cycle is disclosed in U.S. Pat. Nos. 4,897,518 and 4,816,633 to Mucha et al. and for monitoring the current in an induction heating coil is disclosed in U.S. Pat. No. 5,434,389 to Griebel. These prior patents are incorporated by reference herein for general background information as they relate to the conventional induction heating treating processes. Similarly, U.S. Pat. Nos. 3,746,825 and 5,250,776 to Pfaffmann disclose a method for measuring input energy and temperature and heating rate of a workpiece, respectively. U.S. Pat. No. 6,455,825 to Bentley et al. discloses the use of miniature magnetic sensors strategically placed about the workpiece to monitor changes in the magnetic properties of the workpiece as it heats up during induction heating and cools down during quenching. These patents are also incorporated by reference for the further purpose of illustrating the state of the art of induction monitoring systems.

The conventional induction heat treating process is detrimental to the perishable heat treating tool. The tool, or inductor coil, is designed and shaped specifically to the workpiece undergoing the heat treatment. An induction heating machine may include a specifically designed coil, or multiple identical coils mounted to the machine, or various coil designs mounted to a single machine in series, all used for hardening various workpieces during production. Each coil may be formed of multiple copper parts and flux concentrators that are brazed or attached to form an inductor assembly. The joints have a limited life cycle and are prone to failure or leakage and must be repaired. Further, arcing often occurs where there are small air gaps between the tool and the workpiece causing stress cracks and damage to the coil. These examples only exacerbate the already short tooling life of a coil and lead to costly repairs. Each time tooling is changed, the induction heating machine and the heat treated parts must be validated to ensure that the new coil is performing per required specifications. Tooling and production shutdown are costly and time-consuming. Employing multiple coils with each machine, without knowing the cycle history of each individual coil increases the opportunity for production interruption.

Currently, an end user/purchaser of induction heating equipment will contract an induction equipment supplier (OEM) to design an optimal coil configuration for the part requiring induction heating. Based on the quality of material used and quality of workmanship, the coil will need repairing after an unknown amount of cycles. More often than not, the end user will choose to send the coil to an after market company for the repair based mainly on the cost of the repair. A costly inventory of inductor coils is maintained at the production site for immediate replacement when a coil fails during production. Occasionally a replacement coil is removed from inventory without ordering new replacements, thus creating an immediate need for a new replacement coil.

A blind count is recorded of how many times the induction heating machine is cycled for purposes of determining the amount of parts that have been heat treated. However, no record is kept of how many times each individual inductor coil is energized, or cycled. Nor is a record kept of how many different inductor coils are used in a multiple coil machine. Therefore, no hard record is created to determine the cycle life of each inductor coil, i.e. how many cumulative cycles in the life of an average inductor coil. Best estimates are that a perishable coil must be replaced approximately every 5,000 to 100,000 cycles based on each individual application. These tool costs are incorporated into the overall cost of each manufactured part.

When an inductor coil fails, production stops. The coil must be changed and the machine and subsequently heat treated parts must be validated. This requires the transportation and quarantine of the parts to a separate storage area for analysis of quality control. If the parts do not meet the specified criteria, they are scrapped, resulting in an expensive waste of material and labor. The alternative option is to wait until the metallurgical results are verified before running production, this may take hours.

SUMMARY OF THE INVENTION

The present invention provides an induction heat treating process with a sensor for counting the amount of cycles attributable to an individual inductor coil. The sensor is preferably a counting mechanism attached to or embedded within the induction coil or bus bar and is triggered by and responds to the change in voltage generated as the coil is energized. Alternative designs may measure current, magnetic field, frequency and/or temperature differentials on each individual coil. Additionally, the sensor may be an identifier or tag attached to or embedded within the induction coil or bus bar assembly that signals an indicator to an external data maintenance source, such as a control cabinet or personal computer for example, to register a consecutive count of cycles for the identified coil. The data culled from the sensor or other data maintenance and retrieval sources provides useful information for determining the lifespan of an induction coil. Predicting the lifespan of a coil optimizes production by anticipating failure and replacement of a coil during a predetermined down time, limiting on-site inventory, and revolutionizing the repair billing cycle based on a per cycle cost while decreasing overall production costs.

Initially, the sensor is used to measure the amount of cycles sustained by each individual coil until failure of the coil to establish a base line life span of a typical industrial application. To do this, a sensor may be provided as an attachment to a pre-existing production coil. In a preferred embodiment, the sensor is embedded in a bolt typically used to secure the coil bus bar together. When the machine is activated, the sensor responds to the voltage change across the bus bar and signals a single cycle. Each activation, or cycle, of the induction heat treating coil registers a consecutive cycle. The sensor tallies and stores the amount for reading. The sensor may also transmit to an external device such as a bar code reader, hand held personal computer, cellular telephone, or any other device capable of receiving such transmitted information.

Once an average baseline lifespan for each coil design is established, the monitoring system of the present invention can provide useful information to optimize the operation of each induction heating machine and overall production. The monitoring system includes providing an induction coil with a counting sensor attached or embedded within each coil. Preferably, a coil monitoring company provides an induction coil with sensor for lease, rather than purchase, by a company for use during production. As the sensor tallies cycles for each coil, the coil monitoring company as proprietor of the monitoring system reads the output from the sensor and compares the total cycles to the baseline lifespan of each coil design. When a predetermined threshold cycle count is met, the coil monitoring company as part of the overall monitoring system notifies the leasing company of an anticipated need to change a coil before failure. Once removed from the induction heating machine, the coil is preferably forwarded to the coil monitoring company for analysis and distribution to a coil manufacturing company for repair and reuse. Alternatively, the coil monitoring company may repair induction coils in-house. The leasing company is charged for each cycle experienced by the induction coil and does not incur the cost of repair.

Additionally, the system of the present invention provides an efficient method for monitoring on-site induction coil inventory. An induction heating machine using multiple designed coils for hardening various workpieces during production may require the removal of one coil design and replacement with a second coil design. When production using the first coil design resumes, the counting system provides a method for reading the output from each coil sensor. In a preferred embodiment, a hand held reading device such as a bar code reader or personal computer is used to read and analyze the tallied count for each inventoried coil. Alternatively, an LED readout may be provided within the counter mechanism and activated by the push of a button for viewing the number of cycles applicable to a particular coil. This educates the operator as to which coil best suits the needs of current production. The system also aids the operator in determining which coil should be used to replace the failed or failing coil in the example set forth above. With this information the operator can predict and prepare for scheduled coil changeovers to eliminate production downtime.

When the failed coils are returned for repair, the coil monitoring company through the monitoring system further provides a method for establishing industrial standards for induction heating coils. The coil monitoring company through the data culled from the monitoring system will maintain a database for recording the cycle lifespan of a certain coil design and the area of failure, for example. This information is accumulated and can aid in possibly improving the coil design by eliminating repetitive failure areas such as unnecessary or poorly brazed joints or use of inferior brazing material.

The coil monitoring company through monitoring system also provides a means for renovating the costs associated with current production processes. Instead of purchasing induction coils and contracting for repair, the monitoring system provides a method for leasing induction coils and paying on a per cycle basis. A fixed per cycle cost will encourage coil manufacturers to manufacture coils of the highest quality and maintain continuous improvement of production induction coils. This eliminates repair costs and provides a known fixed production price per part. By monitoring the lifespan of an induction coil, the system eliminates unknown costs, increases production, limits inventory, decreases potential waste costs and establishes industrial standards for the manufacturing and design of heating coils.

These and other objects of the present invention will become apparent upon reading the following detailed description in combination with the accompanying drawings, which depict systems and components that can be used alone or in combination with each other in accordance with the present invention.

DESCRIPTION OF THE PREFERRED EMBODIMENT

Figure 1:
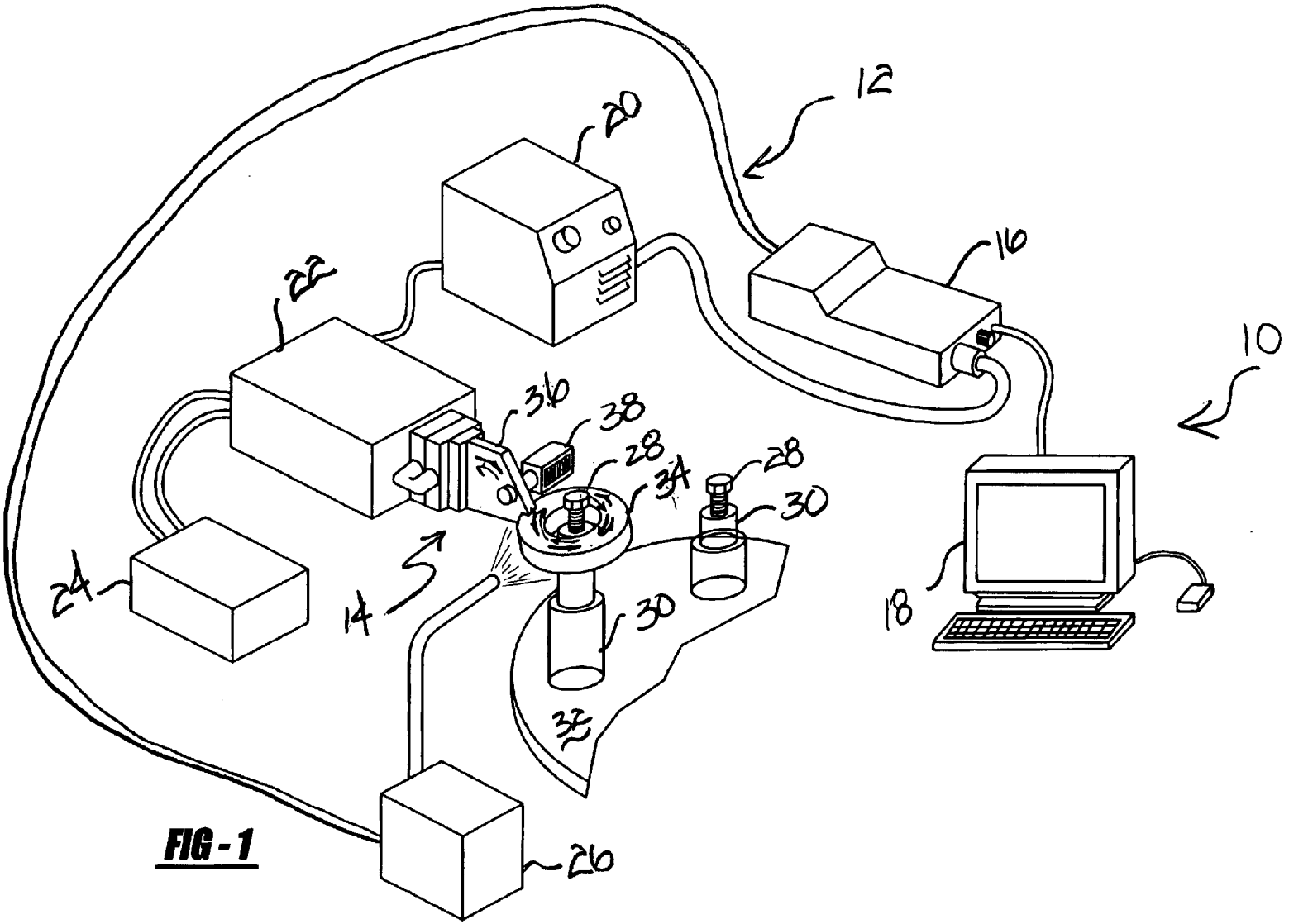
FIG. 1 illustrates a first preferred embodiment of the apparatus and method for monitoring the amount of cycles experienced by an induction coil.
Figure 2:
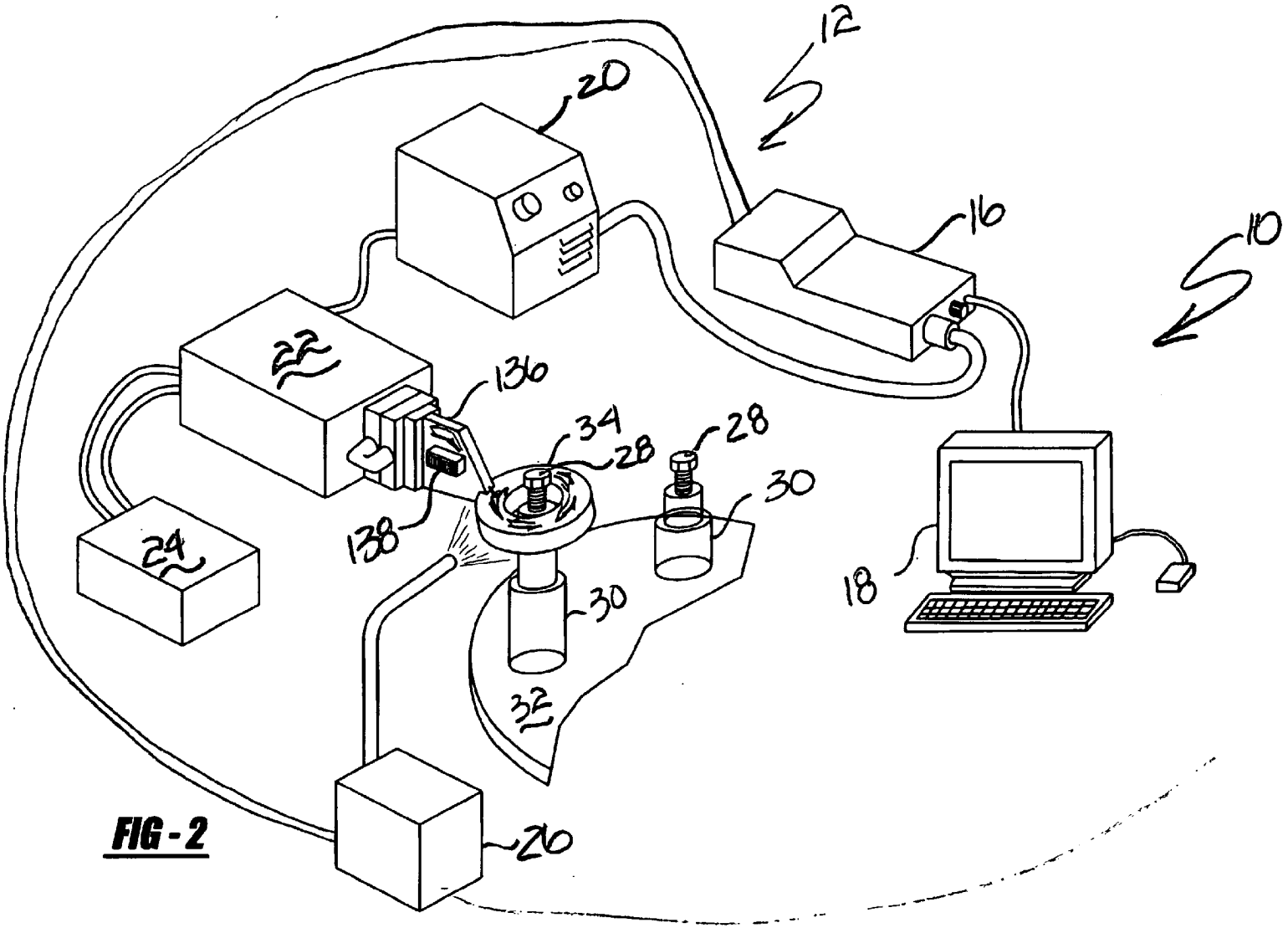
FIG. 2 illustrates a second preferred embodiment of the apparatus and method for monitoring the amount of cycles experienced by an induction coil.

With reference to FIGS. 1 and 2, a monitoring system 10 of the present invention is there shown and includes an induction coil assembly 12 and subassembly 14. The components of the induction coil assembly 12 include a Program Learning Center (PLC) 16 connecting a hard-wired Personal Computer (PC) 18 with a power supply 20. In an industrial setting, the PLC 16 is connected to a control cabinet (not shown) for automation and control of the induction process. The personal computer 18 is illustrated as part of the assembly 12, however, the personal computer 18 may be located off premises and connected to the monitoring system 10 via the Internet or other well-known communication devices.

A transformer 22 is connected to the power supply 20 and connects the induction coil subassembly 14 to the monitoring system 10. A cooling unit 24 for cooling the transformer 22 and coil subassembly 14 during the induction heating process is provided along with a quenching unit 26 for quenching a workpiece 28 after induction heating. The quenching unit 26 is preferably hard-wired to the PLC 16 for receiving information as to when to quench the workpiece 28. The workpiece 28 is shown resting on a tooling nest 30 located on a turntable 32.

The induction coil subassembly includes an induction coil 34 surrounding the workpiece 28 and a bus bar 36 electrically connecting the induction coil 34 to the transformer 22 and power supply 20. A counting sensor 38 is shown removably attached to the bus bar 36 in FIG. 1. FIG. 2 illustrates a second preferred embodiment of the monitoring system 10 of the present invention with a counting sensor 138 embedded within a bus bar 136. The sensor 38,138 may take one of several different forms. The sensor may include a counting mechanism within the body of the sensor, such as the nut and bolt combination illustrated in FIGS. 1 and 3, for after market attachment to an existing induction coil assembly or subassembly. The sensor, with counting mechanism, may also be embedded within the induction coil assembly or subassembly as illustrated in FIG. 2. The sensor may be an identifier or tag, such as a resistor pattern, that signals to an external source, such as a control cabinet, personal computer, bar code identifier, PDA, or cellular telephone, the identity of a particular coil and instructs the computer to begin a consecutive cycle count. As with all forms of sensors, the cycle count along with other pertinent data is input, stored and retrieved for analysis on or off premise.

As is well known in the art, the induction heating process relies on electrical currents within a material to produce heat. The power supply 20 sends alternating current through the induction coil 34, generating a magnetic field. A workpiece 28 is placed in the coil 34 and enters the magnetic field. Alternating current through the coil 34 during the heating cycle causes current flow within the workpiece 28, generating precise amounts of localized heat without physical contact between the coil 34 and the workpiece 28.

Figure 3:
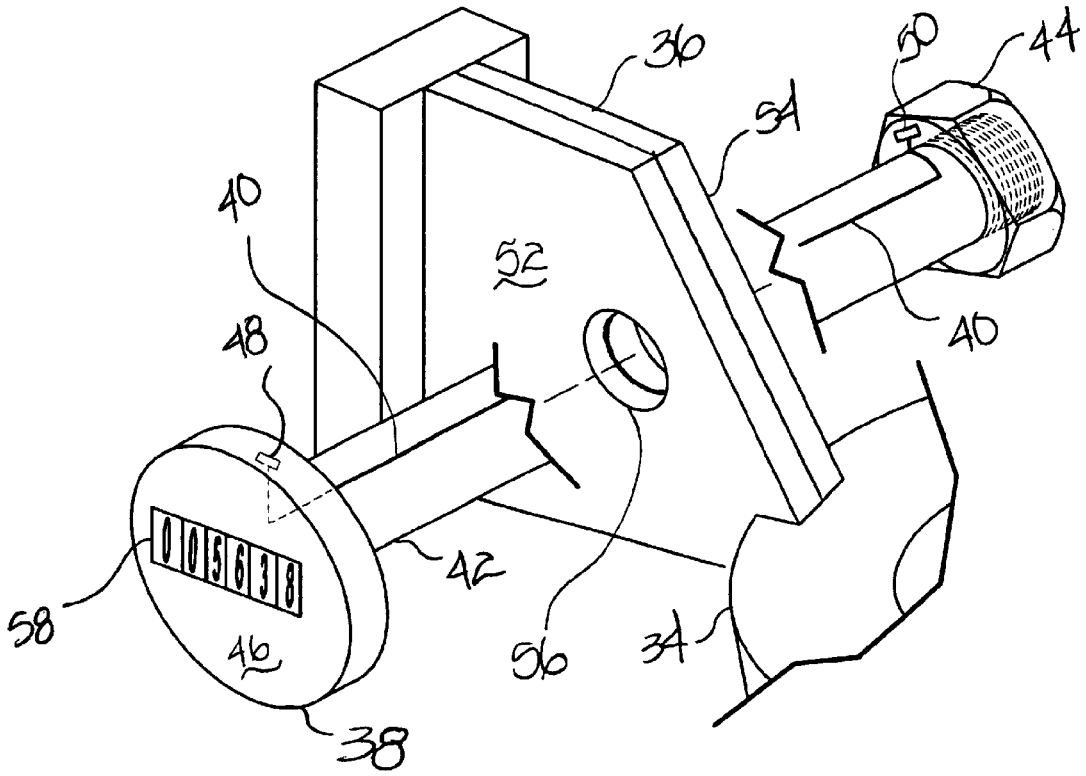
FIG. 3 illustrates a preferred embodiment of the counter with circuitry for measuring voltage change across the bus bar to trigger the counter.
Figure 4:
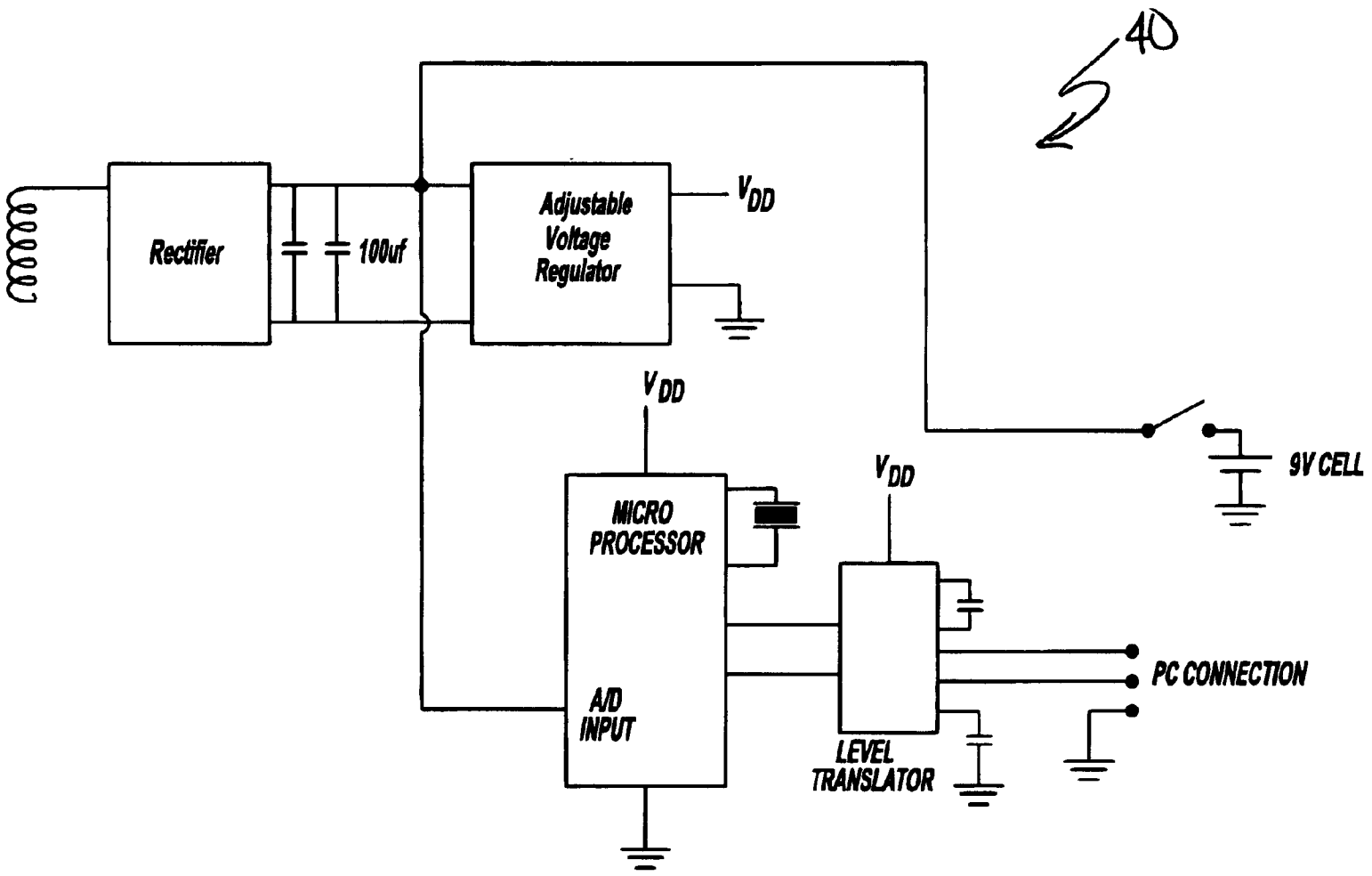
FIG. 4 illustrates an induction coil counter block diagram of a preferred circuit for measuring the voltage change of FIG. 3.

FIGS. 3 and 4 illustrate a preferred embodiment of the counting sensor 38 and circuitry 40 for measuring the change in voltage across the bus bar 36 and triggering the counting sensor 38 when the induction coil 34 is cycled. The counting sensor 38 includes a bolt 42 and nut 44 that serves the dual purpose of housing the circuitry 40 and securing the bus bar 36 within the induction coil subassembly 14. The bolt 42 and nut 44 are preferably formed of a non-conductive or minimally conductive material such as plastic, ceramic, brass or stainless steel as is well known in the industry, thus preventing overheating during the heating cycle. The nut and bolt combination provide an after market counting sensor that can easily replace an existing nut and bolt in induction coil assemblies already in production.

The head 46 of the bolt 42 is provided with a contact point 48 along the interior of the head 46. A second contact point 50 is located within the interior of the nut 44. Both contact points 48, 50 are preferably formed of a conductive material such as copper and will contact the bus bar 36 on opposing sides 52,54, respectively, when the bolt 42 is placed in hole 56 in bus bar 36 and tightly secured by the nut 44. These contact points, 48,50 may be located anywhere along the interior of the head 46 and nut 44 as long as contact is maintained with the bus bar 36 when the bolt 42 is secured. The contact points 48, 50 read the difference of electrical potential, or change in voltage, across the bus bar 36 when the induction coil 34 is cycled, in turn, closing the circuit loop 40 within the bolt 42, triggering the counting sensor 38 to record a consecutive cycle count on a visual display 58. A typical circuit loop 40 is illustrated with a 9 volt cell that connects to a light to illuminate the light when a cycle is visually displayed.

Numerous alternative embodiments of the counting sensor, means for measuring a cycle, means for reading the cycle count, and means for monitoring, recording, displaying and disseminating the cycle count for each induction coil are envisioned and include a counting sensor embedded within the nut and bolt as illustrated in FIG. 2. Alternative means for measuring a cycle include but are not limited to, measuring the change in current, frequency or temperature about the induction coil assembly or using a Hall effect device as described in U.S. Pat. No. 3,388,318 and incorporated by reference herein. In general, the cycle is measured by any means known in the art upon the generation of a magnetic field about an induction coil.

The consecutive cycle count may be recorded for reading visually as illustrated in FIG. 3 or using a bar code reader 38, 138 as shown in FIGS. 1 and 2, respectively. Other recording and transmission devices may be used including a sensor in conjunction with a computer 18, as shown in FIG. 1, that may be hard wired to the monitoring system 10 or any hand held device, commonly referred to as PDA's, for receiving transmitted information via radio or telephone transmissions (land line or cellular.)

Initially, the monitoring system 10 of the present invention provides a method for establishing a baseline lifespan of an induction coil. An induction coil is provided with a sensor, or counting mechanism as described above, for use with an induction coil assembly in a production setting. The counting sensor may be provided as an aftermarket nut and bolt arrangement or may be embedded within the induction coil or bus bar when either is manufactured. The counting mechanism is triggered each time a magnetic field is generated about the coil (illustrated by arrows showing the flowing electricity through the induction coil in FIGS. 1 and 2), i.e. when the induction coil is cycled. The counting sensor measures the change in voltage across the bus bar and consecutively counts or triggers an external source to count a cycle each time the magnetic field is generated. The induction coil is maintained in production and each cycle is counted and recorded by the counting sensor until the coil fails. The final cycle count is recorded by the counting sensor or by other means such as a personal computer receiving the output from the counting sensor. This final cycle count is recorded and maintained by the monitoring system to aid in establishing an average baseline lifespan of similarly shaped induction coils and subassemblies.

Once an average baseline lifespan is established, the monitoring system of the present invention provides a method for monitoring the amount of cycles attributable to an induction coil in production. This method includes providing an induction coil assembly with an induction coil having a counting sensor. The counting sensor is triggered or triggers an external receiver with each cycle of the coil when a magnetic field is generated during the induction process. The counting sensor may be read manually or the sensor may receive the counting data and transmit the output to a monitoring system having a computer or any type of PDA for receiving the output data. The consecutive count for each induction coil is maintained and monitored by the system. The monitoring system may provide a direct means for reading the count, such as a visual system, or may send out a notification via any means such as e-mail, cellular telephone, cellular PDA, cellular or hard-wired computer system, for example, to notify the production assembly of the consecutive cycles sustained by each coil. This cycle count may be compared to the established baseline lifespan of a coil and such information may be used to recommend replacing a coil prior to failure if the cycle count is within a pre-determined range of the average.

Preferably, the monitoring system of the present invention is maintained and controlled by a coil monitoring company. The company provides the induction coils with sensors for lease, rather than purchase, by a company for use during production. As the sensor tallies cycles for each coil, the monitoring system reads the output from the sensor and compares the total cycles to the baseline lifespan of each coil design. When a predetermined threshold cycle count is met, the monitoring system notifies the leasing company of an anticipated need to change a coil before failure. Once removed from the induction heating machine, the coil is preferably forwarded to the coil monitoring company for analysis and distribution to a coil manufacturer for repair and reuse. Alternatively, the coil monitoring company may repair induction coils in-house. The leasing company is charged for each cycle experienced by the induction coil and does not incur the cost of repair.

Additionally, the coil monitoring company provides the monitoring system of the present invention for aiding the leasing company in monitoring on-site induction coil inventory. An induction heating machine using multiple designed coils for hardening various workpieces during production may require the removal of one coil design and replacement with a second coil design. When production using the first coil design resumes, the counting system provides a method for reading the output from each coil sensor. In a preferred embodiment, a hand held reading device such as a bar code reader or personal computer is used to read and analyze the tallied count for each inventoried coil. Alternatively, an LED readout may be provided within the counter mechanism and activated by the push of a button for viewing the number of cycles applicable to a particular coil. This educates the operator as to which coil best suits the needs of current production. The system also aids the operator in determining which coil should be used to replace the failed or failing coil in the example set forth above. With this information the operator can predict and prepare for scheduled coil changeovers to eliminate production downtime.

When the failed coils are returned for repair, the monitoring system further provides a method for establishing industrial standards for induction heating coils. The monitoring system includes maintaining a database for recording the cycle lifespan of a certain coil design and the area of failure, for example. This information is accumulated and can aid in possibly improving the coil design by eliminating repetitive failure areas such as unnecessary or poorly brazed joints or use of inferior brazing material.

The monitoring system also provides a means for renovating the costs associated with current production processes. Instead of purchasing induction coils and contracting for repair, the monitoring system provides a method for leasing induction coils and paying on a per cycle basis. A fixed per cycle cost will encourage coil manufacturers to manufacture coils of the highest quality and maintain continuous improvement of production induction coils. This eliminates repair costs and provides a known fixed production price per part. By monitoring the lifespan of an induction coil, the system eliminates unknown costs, increases production, limits inventory, decreases potential waste costs and establishes industrial standards for the manufacturing and design of heating coils.

Although the invention has been described with particular reference to certain preferred embodiments thereof, variations and modifications can be effected within the spirit and scope of the following claims.

What is claimed is:

1. A method of monitoring the amount of cycles attributable to an induction heating coil comprising the steps of:

providing an induction heating coil with a counting sensor, generating a magnetic field about said induction heating coil; and triggering said counting sensor to increase the count in response to said magnetic field.

2. The method of claim 1, wherein said counting sensor comprises a sensor for receiving and outputting counting data.

3. The method of claim 2, wherein said counting sensor is removably attached to said induction heating coil.

4. The method of claim 2, wherein said counting sensor is embedded within said induction heating coil.

5. The method of claim 2, and further comprising the step of:

said counting sensor consecutively counting each time said sensor is triggered.

6. The method of claim 2, and further comprising the step of:

reading said counting data from said counting sensor.

7. The method of claim 5, and further comprising the step of:

reading said counting data from said counting sensor.

8. The method of claim 1, wherein said counting sensor is an identifier of said induction heating coil, and further comprising the step of: said identifier triggering an external data source to consecutively count each time said induction heating coil is cycled.

9. The method of claim 8, wherein said counting sensor is removably attached to said induction heating coil.

10. The method of claim 8, wherein said counting sensor is embedded within said induction heating coil.

11. The method of claim 8, and further comprising the step of:

reading said counting data from said external source.

12. A method of monitoring the amount of cycles attributable to an induction coil of an induction coil assembly, said assembly comprising a power supply and an induction coil subassembly including said induction coil and a bus bar connecting said coil to said power supply, the method comprising the steps of:

providing an induction coil subassembly with a counting sensor, wherein said counting sensor comprises a sensor for receiving and outputting counting data;

generating a magnetic field about said coil;

triggering said counter when said magnetic field is generated, wherein said counting sensor consecutively counts a cycle each time said magnetic field is generated about said coil;

maintaining said coil within said induction coil subassembly and continuing to consecutively count said cycles until said coil fails, reading said output data of said counting sensor, wherein said output data comprises the total amount of consecutive cycles sustained by said coil; and establishing a baseline lifespan for said coil based on said output data.

13. The method of claim 12, and further comprising the steps of:

providing a series of like induction coil subassemblies each with said counting sensor;

generating a magnetic field about each coil of said induction coil subassemblies;

triggering each of said counting sensors when said magnetic field is generated;

maintaining each of said coils within said induction coil subassemblies and continuing to consecutively count said cycles until each of said coil fails;

reading said output data of each said counting sensors; wherein said output data comprises the total amount of consecutive cycles sustained by each of said coils; and establishing an average baseline lifespan for said like coils based on said output data.

14. The method of claim 12, and further comprising the step of:

replacing said coil with a new coil upon said failure.

15. The method of claim 13, and further comprising the steps of:

once said average baseline lifespan is established for said like coils, replacing at least one of said coils with a new like coil upon said failure, wherein said new coil comprises a counting sensor including a sensor for receiving and outputting counting data;

monitoring said consecutive cycles sustained by said replaced coil by reading said output data; and recommending replacing said replaced coil prior to failure of said coil if said cycles are within a pre-determined range of said average baseline lifespan for said like coils.

16. The method of claim 12, wherein said counting sensor is removably attached to said bus bar.

17. The method of claim 12, wherein said counting sensor is embedded within said induction coil subassembly.

18. The method of claim 15, further comprising the step of:

replacing said replaced coil with a new coil having a counting sensor including a sensor for receiving and outputting counting data.

19. A method of monitoring the amount of cycles attributable to an induction coil of an induction coil assembly comprising a power supply and an induction coil subassembly comprising said induction coil and a bus bar connecting said induction coil to said power supply, wherein an average baseline lifespan for said induction coil has been established, the method comprising the steps of:

providing said induction coil subassembly with a counting sensor, wherein said counting mechanism comprises a sensor for receiving and outputting counting data;

generating a magnetic field about said coil;

triggering said counting sensor when said magnetic field is generated, wherein said counting sensor consecutively counts a cycle each time said magnetic field is generated about said coil;

reading said output data of said counting sensor, wherein said output data comprises the total amount of consecutive cycles sustained by said coil;

monitoring said consecutive cycles sustained by said coil by reading said output data; and recommending replacing said coil prior to failure of said coil if said cycles are within a pre-determined range of said average baseline lifespan for the like coils.

20. The method of claim 19, wherein said counting sensor is removably attached to said bus bar.

21. The method of claim 19, wherein said counting sensor is embedded within said induction coil subassembly.

22. The method of claim 19, wherein said counting sensor is triggered by a change in voltage across said induction coil subassembly when said power supply is activated.

23. The method of claim 19, wherein said counting sensor is triggered by any one of the following events when said magnetic field is generated about said induction coil: a temperature differential, a current flow differential, a frequency differential, or a magnetic field differential causing a Hall effect.

24. The method of claim 19, further comprising the step of:

replacing said replaced coil with a new coil having a counting sensor including a sensor for receiving and outputting counting data.

* * * * *